US012428949B1

(12) United States Patent
Johnson

(10) Patent No.: US 12,428,949 B1
(45) Date of Patent: Sep. 30, 2025

(54) DOWNHOLE GYROSCOPE EMPLOYING A NON-CONTACT GYROSCOPE INDEXING MECHANISM

(71) Applicant: Schlumberger Technology Corporation, Sugar Land, TX (US)

(72) Inventor: James Michael Johnson, Elmwood, NE (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/602,250

(22) Filed: Mar. 12, 2024

(51) Int. Cl.
*E21B 47/022* (2012.01)
*E21B 47/024* (2006.01)

(52) U.S. Cl.
CPC ..... *E21B 47/022* (2013.01); *E21B 47/024* (2013.01)

(58) Field of Classification Search
CPC ..... E21B 47/022; E21B 47/024
See application file for complete search history.

(56) References Cited

U.S. PATENT DOCUMENTS

2020/0072038 A1 3/2020 Weston
2020/0132458 A1 4/2020 Johnson
2024/0060414 A1* 2/2024 Tokle ..... E21B 47/024

FOREIGN PATENT DOCUMENTS

EP 1426552 A2 * 6/2004 ..... E21B 47/022

* cited by examiner

*Primary Examiner* — Dany E Akakpo

(57) ABSTRACT

A downhole gyroscopic surveying tool includes a gyroscopic sensor deployed in and configured to rotate between a first rotational position and a second rotational position about an indexing axis in a downhole tool body. A non-contact detent is configured to secure the gyroscopic sensor in either the first rotational position or the second rotational position. A drive mechanism is configured to rotate the gyroscopic sensor between the first rotational position and the second rotational position and is configured to be in a non-contact engagement with the gyroscopic sensor when the gyroscopic sensor is in the first position or the second position.

19 Claims, 5 Drawing Sheets

DOWNHOLE GYROSCOPE EMPLOYING A NON-CONTACT GYROSCOPE INDEXING MECHANISM

FIELD

Disclosed embodiments relate generally to downhole gyroscopic surveying tools and more particularly to a downhole gyroscopic surveying tool employing a non-contact gyroscope indexing mechanism.

BACKGROUND

Gyroscopes are commonly utilized in wellbore surveying operations. Gyroscopic surveying measurements may be used to measure wellbore azimuth with respect to true north (e.g., in a global north-east-down NED coordinate system). Such measurements are sometimes referred to as gyrocompass measurements. Gyroscopic measurements may be advantageous in certain surveying operations as they are generally not susceptible to magnetic interference.

Gyroscopes used in wellbore surveying operations are configured to sense the rotation of the Earth about its axis and to determine a magnitude (or magnitudes) of one or more components of Earth's rotation (e.g., the horizontal component). Since the rotation rate of the earth is slow (one full rotation per day), gyroscopic survey sensors generate very small electrical signals. High precision instrumentation is therefore required to make acceptably accurate surveying measurements. To achieve such high precision, gyroscopic surveying measurements commonly employ indexing to remove sensor bias.

While conventional indexing techniques are commercially serviceable for many subterranean surveying operations, there is room for further improvement. For example, there is often significant residual bias (sometimes referred to as non-index bias) remaining after a gyroscopic indexing procedure. There is a need for a measurement apparatus and method that reduces such residual bias and thereby enables gyroscopic measurements to be made with improved accuracy.

SUMMARY

A downhole gyroscopic surveying tool includes a downhole tool body; a gyroscopic sensor deployed in and configured to rotate between a first rotational position and a second rotational position about an indexing axis in the downhole tool body; a non-contact detent configured to secure the gyroscopic sensor in either the first rotational position or the second rotational position; and a drive mechanism configured to rotate the gyroscopic sensor between the first rotational position and the second rotational position, the drive mechanism configured to be in a non-contact engagement with the gyroscopic sensor when the gyroscopic sensor is in the first position or the second position.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

A downhole gyroscopic surveying tool includes a gyroscopic sensor deployed in and configured to rotate between a first rotational position and a second rotational position about an indexing axis in a downhole tool body. A non-contact detent, such as a non-contact magnetic detent, is configured to secure the gyroscopic sensor in either the first rotational position or the second rotational position. A drive mechanism is configured to rotate the gyroscopic sensor between the first rotational position and the second rotational position and is configured to be in a non-contact engagement with the gyroscopic sensor when the gyroscopic sensor is in the first position or the second position. The drive mechanism may include, for example, an electric motor and first and second intermittent gears.

Example embodiments disclosed herein may provide various technical advantages and improvements over the prior art. For example, the use of a non-contact indexing mechanism may reduce or eliminate indexing errors associated with gear backlash in the rotary mechanism. A non-contact indexing mechanism may further reduce or eliminate stress or vibration induced indexing errors. A non-contact indexing mechanism may further be robust to wear induced variability and may therefore provide improved service life.

Figure 1:
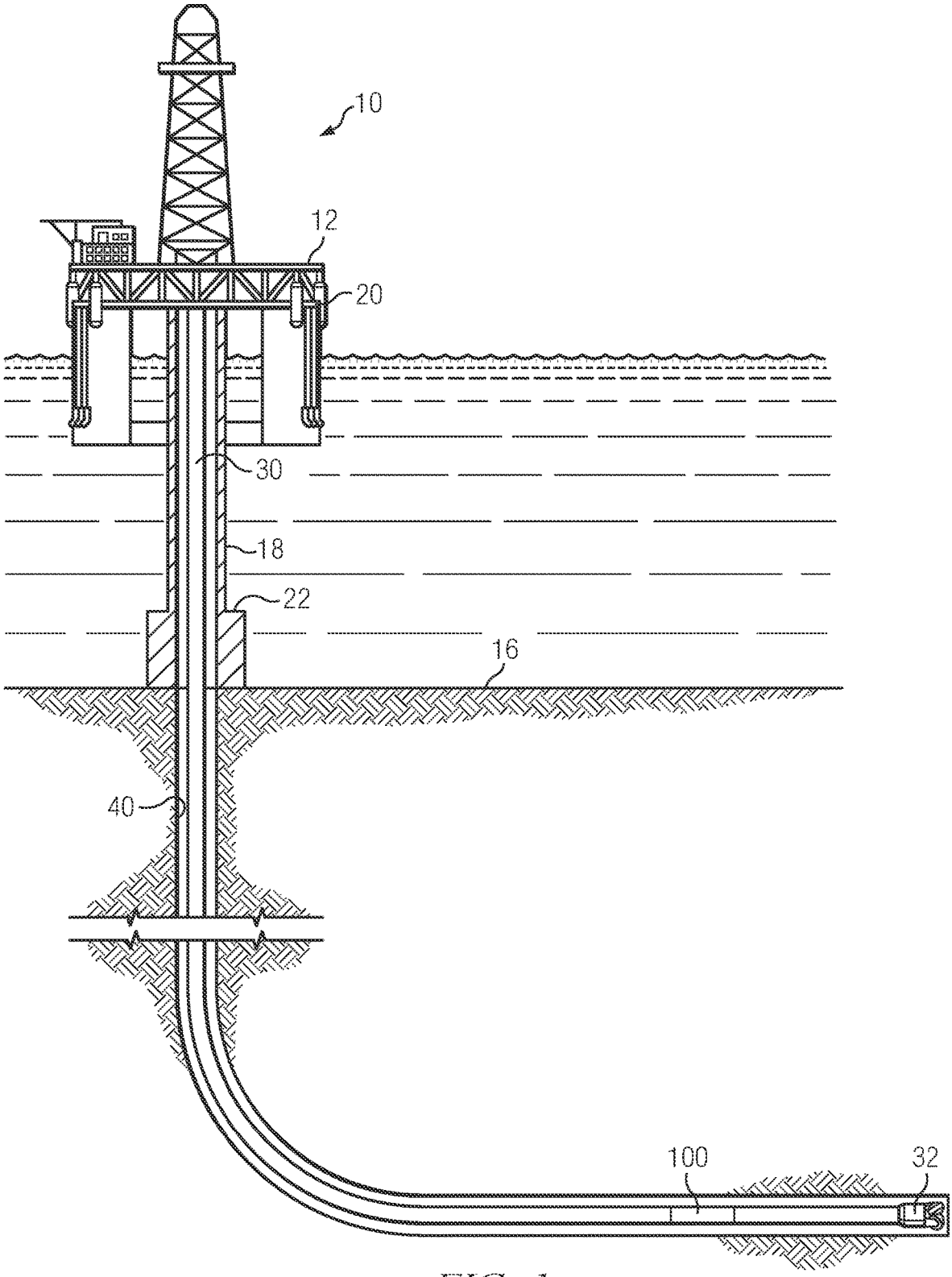
FIG. 1 depicts a drilling rig including one example gyroscopic surveying tool.

FIG. 1 depicts a drilling rig 10 including a disclosed gyroscopic surveying tool 100. A semisubmersible drilling platform 12 is positioned over an oil or gas formation disposed below the sea floor 16. A subsea conduit 18 extends from deck 20 of platform 12 to a wellhead installation 22. The platform may include a derrick and a hoisting apparatus for raising and lowering a drill string 30, which, as shown, extends into wellbore 40 and includes a drill bit 32 and one embodiment of a disclosed gyroscopic surveying tool 100. The drill string 30 may further include substantially any suitable downhole tools, for example, including a drilling motor, a downhole telemetry system, a rotary steerable tool, and one or more other measurement while drilling (MWD) or logging while drilling LWD tools including various sensors for sensing downhole characteristics of the wellbore and the surrounding formation. The disclosed embodiments are not limited in these regards.

As described in more detail below, example embodiments of the gyroscopic surveying tool 100 may include substantially any suitable gyroscope sensor, for example, a microelectromechanical systems (MEMS) gyroscope, a mechanical gyroscope, and/or an optical gyroscope. As known to those of ordinary skill in the art, MEMS gyroscopes are fabricated using integrated circuit fabrication technology and are used in a wide range of applications including spacecraft, aircraft, underwater devices, motor vehicles, gaming devices, and smart phones. Moreover, the gyroscopic surveying tool 100 may include substantially any suitable sensor arrangement(s), for example, a single axis gyroscope, a two-axis (biaxial) gyroscope or a three-axis (triaxial) gyroscope. The disclosed embodiments are not limited in these regards.

It will be understood by those of ordinary skill in the art that the deployment illustrated on FIG. 1 is merely an example. It will be further understood that the disclosed embodiments are not limited to use with a semisubmersible platform 12 as illustrated on FIG. 1. The disclosed embodiments are equally well suited for use with any kind of subterranean drilling operation, either offshore or onshore. Moreover, it will be understood that the disclosed embodiments are not limited to LWD gyroscopic tools as depicted on FIG. 1, but may also include wireline gyroscopic surveying tools.

Figure 2:
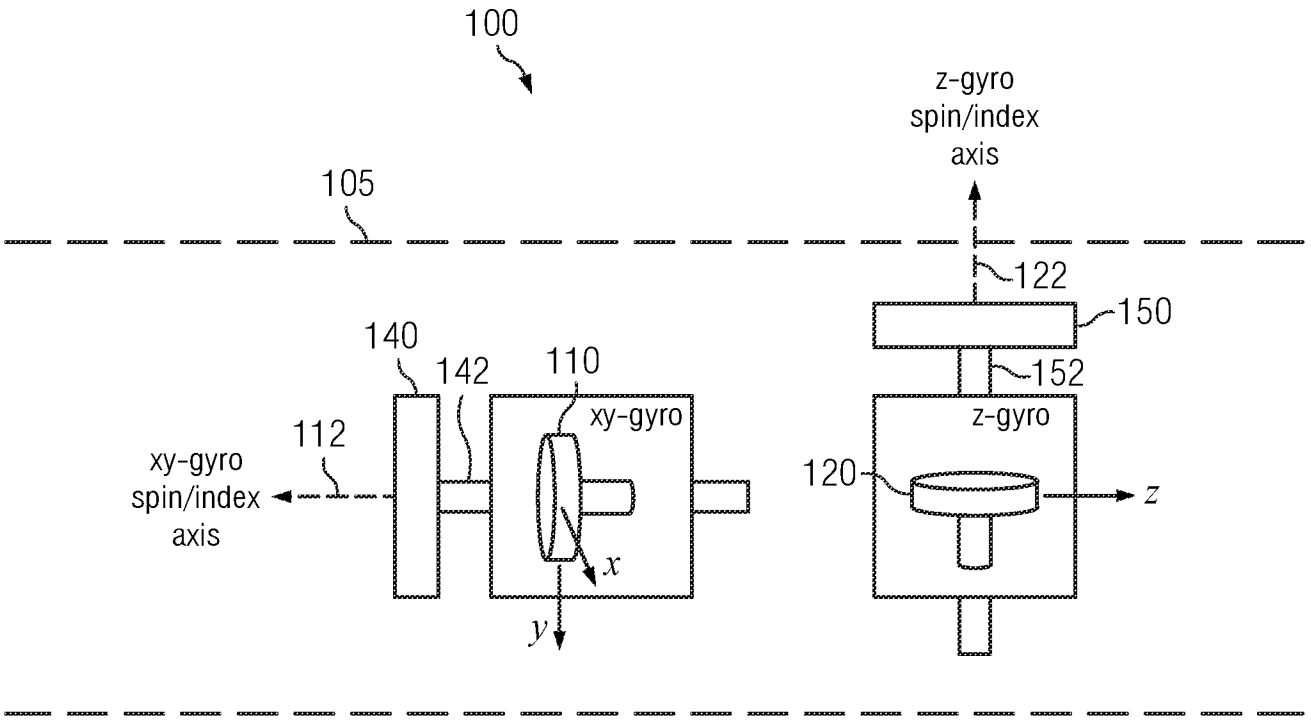
FIG. 2 depicts a cross section of an example gyroscopic surveying tool.

FIG. 2 depicts one example embodiment of gyroscopic surveying tool 100 including first and second gyroscopic sensors 110 and 120 deployed in a sensor housing 105. In the depicted example embodiment, the first gyroscopic sensor 110 includes an xy-gyro and the second gyroscopic sensor 120 includes a z-gyro. By xy-gyro it is meant that the first gyroscopic sensor 110 is configured to generate measurement signals indicative of at least one component of the Earth's rotation that is perpendicular to the axis of the wellbore (e.g., in the x-direction). In example configurations, the first gyroscopic sensor 110 may be further configured to generate measurement signals indicative of a component of the Earth's rotation in a y-direction that is perpendicular to both the x-direction and the axis of the wellbore. By z-gyro it is meant that the second gyroscopic sensor 120 is configured to generate measurement signals indicative of a component of the Earth's rotation that is parallel with the axis of the wellbore (the z-direction). It will therefore be understood that in the depicted example embodiment the measurement axes of the first gyroscopic sensor 110 are mutually orthogonal to one another and to the measurement axis of the second gyroscopic sensor 120. It will be further appreciated that the first and second gyroscopic sensors 110 and 120 together may be configured to make triaxial gyroscopic sensor measurements (e.g., x-, y-, and z-direction measurements).

As noted above, the first and second gyroscopic sensors 110 and 120 may include substantially any suitable gyroscopes. While the disclosed embodiments are not limited to any particular type or style of gyroscopic sensor (e.g., a MEMS gyro or a fiber optic gyro), it will be appreciated that the first and second gyroscopic sensors 110 and 120 may advantageously be configured to provide accurate measurements of the Earth's rotation rate (e.g., having a resolution of less than 0.05 degrees per hour or even having a resolution of less than 0.01 degrees per hour). Moreover, the first and second gyroscopic sensors 110 and 120 may be sufficiently small to be accommodated in a downhole tool (e.g., within the confines of a 50 mm diameter pressure housing in an MWD tool or a rotary steerable tool) and capable of operating at high downhole temperatures (e.g., up to and exceeding 150 degrees C.). Advantageous gyroscopic sensors may be further capable of surviving the severe vibration and shock that can occur during a drilling operation. In some example embodiments, the first and second gyroscopic sensors 110 and 120 may advantageously include MEMS sensors.

It will, of course, be further understood that the disclosed embodiments are not limited to the particular gyroscopic sensor arrangement shown on FIG. 2. As described above with respect to FIG. 1, the disclosed embodiments may include substantially any suitable sensor arrangement(s), for example, including a single axis gyroscope, a two-axis (biaxial) gyroscope, or a three-axis (triaxial) gyroscope.

With continued reference to FIG. 2, the first and second gyroscopic sensors 110 and 120 are configured to rotate about corresponding first and second indexing axes 112 and 122. Such rotation may be accomplished using substantially any suitable rotary mechanism. For example, a first electric motor 140 may be rotationally coupled with the first gyroscopic sensor 110 via shaft 142 and may be configured to rotate the first gyroscopic sensor 110 about the first indexing axis 112. Likewise, a second electric motor 150 may be rotationally coupled with the second gyroscopic sensor 120 via shaft 152 and may be configured to rotate the second gyroscopic sensor 120 about the second indexing axis 122. The disclosed embodiments are, of course, not limited in these regards.

As is well-known in the industry, gyroscopic sensors often have a large bias that can compromise measurement accuracy. A sensor bias is commonly understood to be a measured sensor output when the sensor input (e.g., Earth's rotation for a gyroscope) is zero. Thought of another way, sensor bias is the difference between the actual sensor output and the true sensor output when the sensor input is zero. For gyroscopic sensors, the sensor bias can have numerous root causes, for example, including sensor imperfections, mechanical misalignments, electrical noise, and electrical component offsets or biases (among others).

Owing to the random nature of the bias (from one gyroscopic sensor to the next) and the large uncertainty associated with predicting the bias, the gyroscopic sensor bias is commonly removed via indexing (which is sometimes also referred to as flipping or maytagging in the industry). Such indexing may include rotating the gyroscopic sensor to two or more rotational positions (e.g., using the gimbaling mechanisms described above with respect to FIG. 2) and making gyroscopic measurements at each rotational position. These measurements may then be combined (e.g., via subtracting one from the other) to remove or cancel the bias.

In one such well-known indexing procedure, gyroscopic sensor measurements may be made at two distinct rotational positions that are 180 degrees apart from one another. Bias corrected measurement may be determined, for example, by calculating a difference between the two measurements (made at the two rotational positions) and then dividing the difference by two. Moreover, the magnitude of the bias may be determined, for example, by calculating a sum of the two measurements and then dividing the sum by two.

While the above-described indexing techniques are commercially serviceable for many subterranean surveying operations, residual bias often remains after a gyroscopic indexing procedure. Such residual bias can be sizable and may lead to significant surveying errors. One aspect of the disclosed embodiments was the realization that residual bias may be the result of imprecise indexing action that can result from backlash (also referred to as lash, play, or slop) in the rotary mechanism used to rotate the gyroscopic sensors. As such, the first and second rotational positions may not be repeatable, nor may they be precisely 180 degrees apart. Moreover, it was further realized that such backlash may change with temperature and the thermal expansion coefficients of the gears and shafts used to rotate the gyroscopic sensors. It will still further be realized that residual bias may result from vibrational amplification that can be influenced by the rotary mechanism used to rotate the gyroscopic sensors.

In example embodiments, disclosed gyroscopic sensors include a non-contact indexing mechanism. For example, the gyroscopic sensor may employ a non-contact detent configured to secure the gyroscopic sensor in one of the first or second rotational positions. A drive mechanism may be employed to rotate the gyroscopic sensor between the first and second rotational positions. The drive mechanism may be configured to be in a non-contact engagement with the gyroscopic sensor when the gyroscopic sensor is in the first position or the second position. Example embodiments are described in more detail below with respect to FIGS. 3-5.

Figure 3:
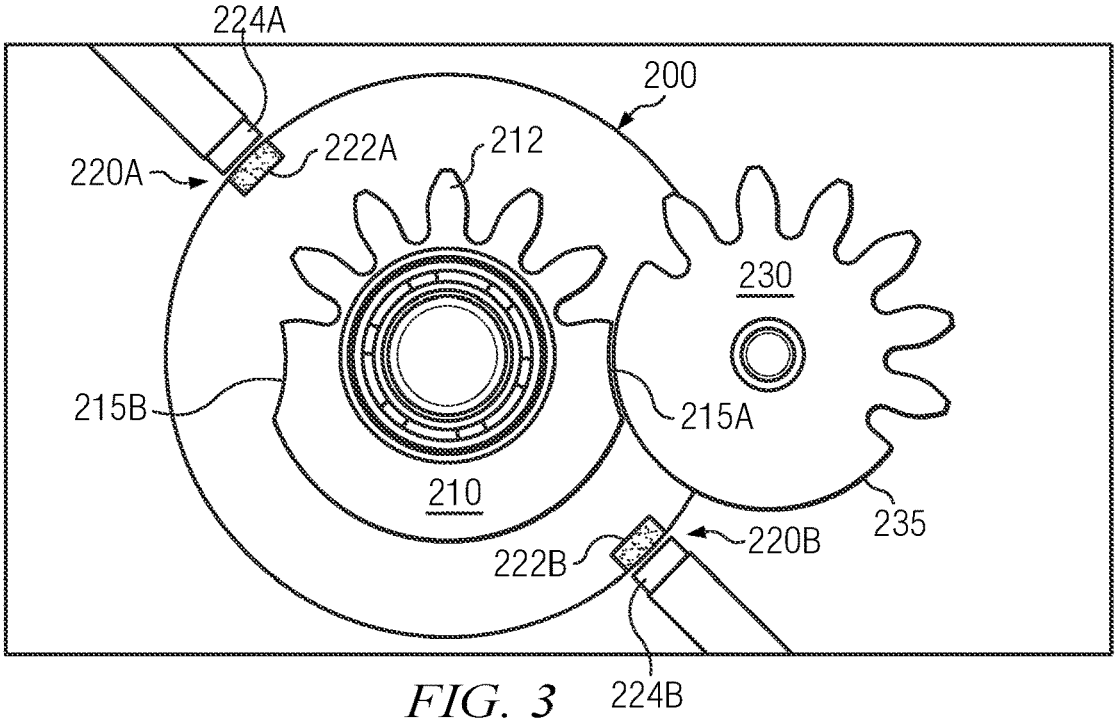
FIG. 3 depicts one example gyroscopic sensor arrangement.

FIG. 3 depicts one example gyroscopic sensor arrangement. In the depicted embodiment a gyroscope 200 (such as gyroscopic sensor 110 or 120 in FIG. 2) is rotationally coupled with a first intermittent gear 210. By intermittent gear it is meant that the gear teeth 212 do not extend about the full periphery of the gear. The intermittent gear 210 further includes first and second alignment features 215A, 215B that are rotationally offset from one another. The first and second alignment features 215A, 215B are sized and shaped (e.g., having a radius of curvature) for non-contact engagement with a nontoothed section 235 of a second intermittent gear 230 that is rotationally coupled to a motor (e.g., an electric motor).

The gyroscope 200 further includes first and second, diametrically opposed (e.g., circumferentially spaced apart by 180 degrees) magnets 222A, 222B. The magnets 222A, 222B are deployed to magnetically engage and disengage from corresponding magnets 224A, 224B disposed in an outer housing. The resulting magnetic pairs 220A, 220B are configured to secure the gyroscope at first and second rotational (indexing) positions without contacting one another (via a non-contact magnetic engagement). In the depicted example embodiment, first and second intermittent gears 210, 230 make a non-contact engagement with one another (e.g., via an air gap between one of the alignment features 215A, 215B in the first intermittent gear 210 and the non-toothed section 235 of the second intermittent gear 230) when the magnets 222A, 222B are in a non-contact engagement with magnets 224A, 224B.

It will be appreciated that gross alignment features in the first intermittent gear 210 that are sized and shaped to form an air gap between the alignment features and the non-toothed section 235 of the second intermittent gear 230 may help prevent the gyroscope from being pulled away from the magnetic poles during shock and vibrations experienced while drilling. This may further hinder the geartrain from jamming due to orientation errors. While collecting gyroscopic data, the housing is generally stationary, allowing the magnetic pairs to hold the gyro in alignment and prevent the gear and gross alignment features from contacting each other. The non-contact engagement further reduces vibrations and mitigates against vibrational amplification between the tool body in the gyroscopic sensor.

Figure 4A:
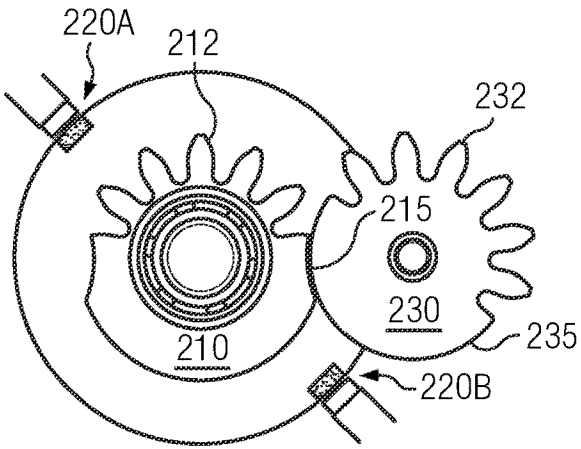
FIGS. 4A, 4B, 4C, 4D, 4E, and 4F (collectively FIG. 4) depict a gyroscopic indexing operation employing the gyroscopic sensor arrangement depicted on FIG. 3.
Figure 4B:
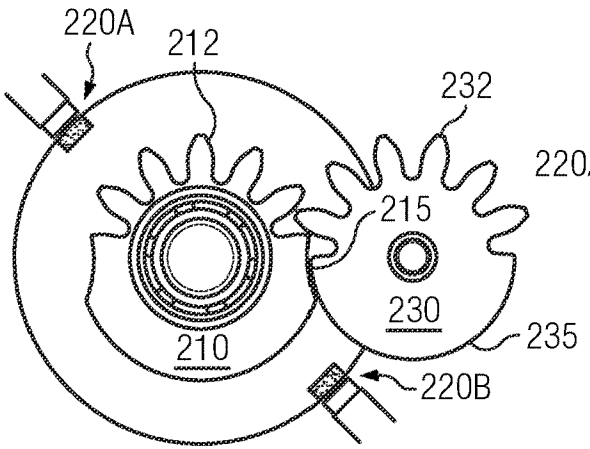
Figure 4C:
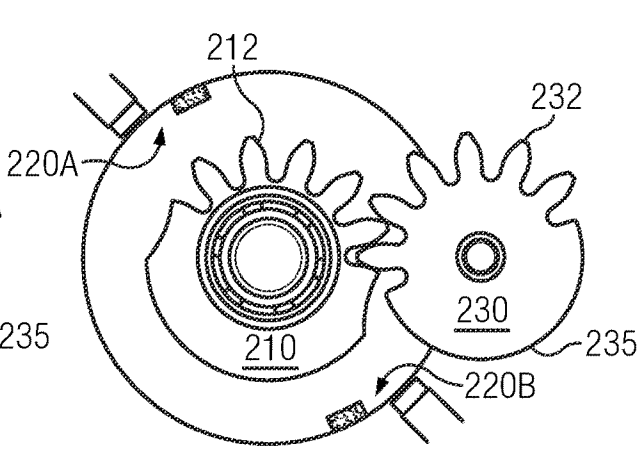
Figure 4D:
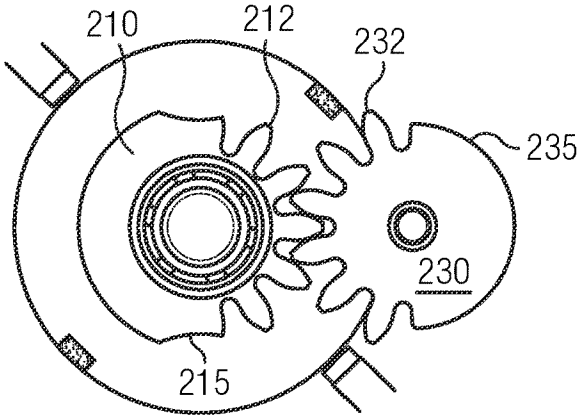
Figure 4E:
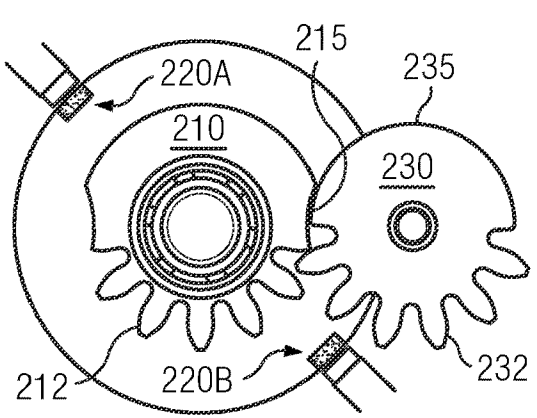
Figure 4F:
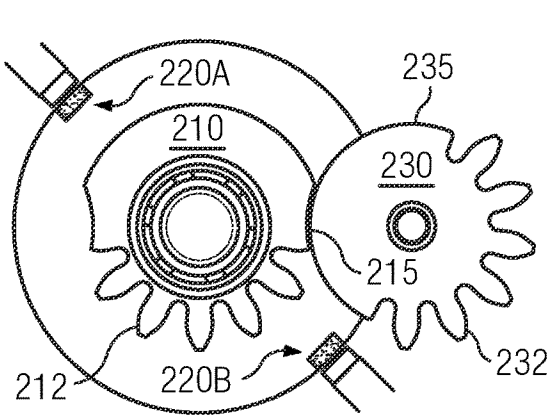

FIGS. 4A, 4B, 4C, 4D, 4E, and 4F (collectively FIG. 4) depict a gyroscopic indexing operation employing the gyroscopic sensor arrangement depicted on FIG. 3. In FIG. 4A, the gyroscopic sensor is magnetically secured in the first rotational position (position 0) via the non-contact magnetic engagement of the magnetic pairs 220A, 220B (the magnetic detent). Moreover, in this first position, the teeth 232 in the second intermittent gear 230 are rotated out of engagement with the teeth 212 in the first intermittent gear 210 such that the alignment feature 215 in the first intermittent gear 210 is in non-contact engagement with the nontoothed section 235 of the second intermittent gear 230. A first gyroscopic indexing measurement is made in this first position. The second intermittent gear 230 is then rotated such that the teeth 232 come into contact with the teeth 212 of the first intermittent gear 210 while the magnetic pairs 220A, 220B remain engaged (and the gyroscope remains in the first position) in FIG. 4B. Further rotation of the second intermittent gear 230 rotates the first intermittent gear 210 thereby breaking the magnetic engagement of the magnetic detent 220A, 220B in FIG. 4C. Continued rotation of the second intermittent gear 230 rotates the first intermittent gear 210 one half turn (180 degrees) until the magnetic detent 220A, 220B are in non-contact magnetic engagement and the gyroscope is in the second position (position 1) in FIGS. 4D and 4E. The second intermittent gear 230 is further rotated such that the teeth 232 become disengaged with the teeth 212 in the first intermittent gear 210 and the alignment feature 215 in the first intermittent gear 210 engages with the nontoothed section 235 of the second intermittent gear 230 in FIG. 4F. A second gyroscope measurement is made in this second position.

Figure 5:
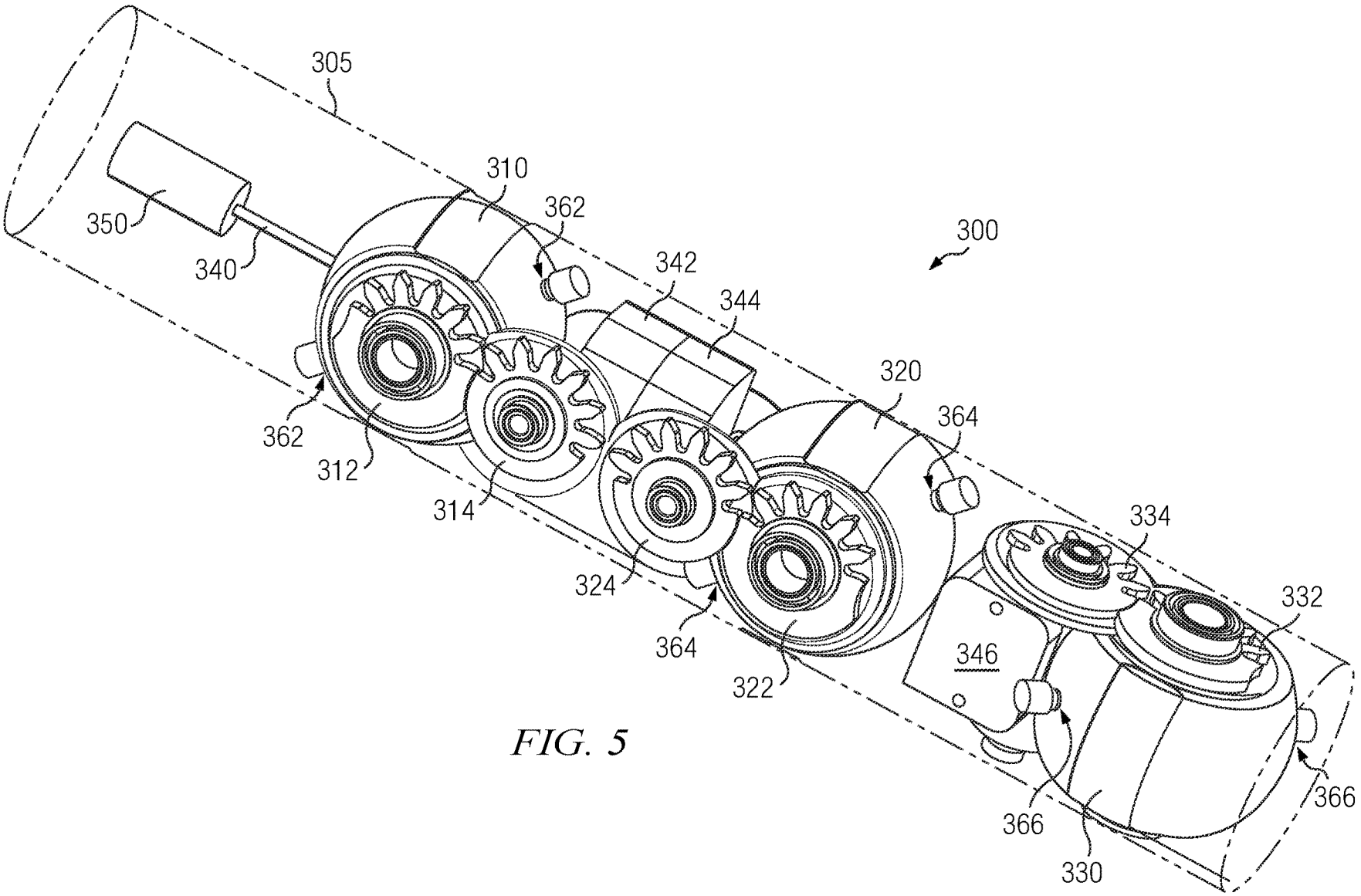
FIG. 5 depicts another example gyroscopic sensor arrangement configured for deployment in a downhole tool.

FIG. 5 depicts another example gyroscopic sensor arrangement 300 configured for deployment in a downhole tool such as an MWD tool or a rotary steerable tool. The depicted embodiment is similar to example embodiment described above with respect to FIGS. 3 and 4 in that it includes at least one gyroscopic sensor having a non-contact indexing arrangement. The example gyroscopic sensor arrangement 300 includes first, second, and third gyroscopic sensors 310, 320, and 330 spaced apart in a cylindrical tool housing 305. The first, second, and third gyroscopic sensors 310, 320, and 330 may collectively make up a triaxially gyroscopic sensor arrangement and may include x-, y-, and z-axis gyroscopic sensors. As described above, each of the gyroscopic sensors 310, 320, and 330 may include substantially any suitable type of gyroscopic sensor, for example, including a MEMS gyroscope.

In the depicted embodiment each of the gyroscopic sensors 310, 320, and 330 is rotationally coupled with a corresponding first intermittent gear 312, 322, and 332 which is in turn engaged with a corresponding second intermittent gear 314, 324, and 334. The second intermittent gears 314, 324, and 334 are rotationally coupled with a motor 350 (e.g., via a drive shaft 340 and corresponding gear boxes 342, 344, and 346). In the depicted example embodiment, the first and second intermittent gears are similar to those described previously with respect to FIGS. 3 and 4 in that the first intermittent gears include corresponding alignment features that are sized and shaped for non-contact engagement with a nontoothed section of the corresponding second intermittent gear.

With continued reference to FIG. 5, each of the first, second, and third gyroscopic sensors 310, 320, and 330 further includes a magnetic detent including diametrically opposed magnetic pairs 362, 364, 366 that are configured to secure the gyroscope at first and second rotational (indexing) positions. These magnetic detents may be configured, for example, as described above with respect to FIGS. 3 and 4 to provide a non-contact magnetic engagement of the gyroscopic sensors 310, 320, and 330 and the cylindrical tool housing 305. The depicted example gyroscopic sensor arrangement 300 may be indexed, for example, as also described above with respect to FIGS. 3 and 4. First gyroscopic measurements may be made using the first, second, and third gyroscopic sensors 310, 320, and 330 when they are in a first rotational position. The motor 350 may be actuated to rotate each of the sensors 310, 320, and 330 to corresponding second, diametrically opposed, rotational positions at which corresponding second gyroscopic measurements are made.

While not depicted in FIGS. 2-5, it will be understood that disclosed gyroscopic surveying tools may further includes an electronic controller. A suitable controller may include, for example, a programmable processor, such as a digital signal processor or other microprocessor or microcontroller and processor-readable or computer-readable program code embodying logic. The controller may be utilized, for example, to receive gyroscope measurements from the depicted gyroscopes (or to cause the gyroscopic sensors to make the measurements). Moreover, a suitable controller may be configured to execute the disclosed method embodiments (or various steps in the method embodiments) described in more detail below with respect to FIG. 6, for example, for indexing gyroscope measurements (or making indexed measurements). A suitable controller may also optionally include other controllable components, such as sensors (e.g., a temperature sensor), data storage devices, power supplies, timers, and the like. The controller may also be disposed to be in electronic communication with the accelerometers and magnetometers. A suitable controller may also optionally communicate with other instruments in the drill string, such as, for example, telemetry systems that communicate with the surface. A suitable controller may further optionally include volatile or non-volatile memory or a data storage device.

Figure 6:
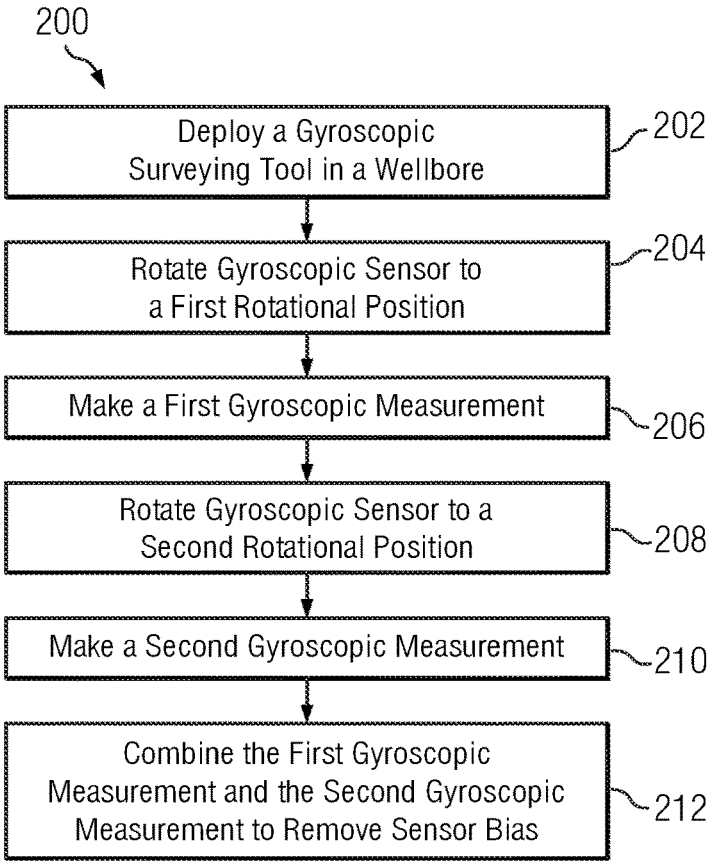
FIG. 6 depicts a flow chart of one example method for indexing a downhole gyroscopic sensor.

FIG. 6 depicts a flow chart of one example method 200 for indexing (making an indexed gyroscope measurement) a downhole gyroscope. The gyroscopic surveying tool (such as described above with respect to FIGS. 2-5) is deployed in a subterranean wellbore at 202. The gyroscopic sensor (or sensors) is rotated to the first rotational position at 204 and used (in the first rotational position) to make a first gyroscopic measurement at 206. The gyroscopic sensor (or sensors) is then rotated to the second rotational position at 208 and used (in the second rotational position) to make a second gyroscopic measurement at 210. The first and second gyroscopic measurements are then combined at 212, for example as described above, to remove the sensor bias (e.g., to obtain a gyroscopic sensor measurement with reduced or eliminated bias). It will be appreciated, that rotating the gyroscopic sensor to the first rotational position at 204 or rotating the gyroscopic center to the second rotational position at 208 may include rotating the second intermittent gear out of the non-contact engagement with the first intermittent gear such that at least one tooth in the second intermittent gear engages at least one tooth in the first intermittent gear. The rotating may further include rotating the second intermittent gear to rotate the gyroscopic sensor to either the first rotational position or the second rotational position (from the opposing second or first position). The rotating may still further include rotating the second intermittent gear into the non-contact engagement with the first intermittent gear.

It will be understood that the present disclosure includes numerous embodiments. These embodiments include, but are not limited to, the following embodiments.

In a first embodiment, a downhole tool includes a downhole tool body; a gyroscopic sensor deployed in and configured to rotate between a first rotational position and a second rotational position about an indexing axis in the downhole tool body; a non-contact detent configured to secure the gyroscopic sensor in either the first rotational position or the second rotational position; a drive mechanism configured to rotate the gyroscopic sensor between the first rotational position and the second rotational position, the drive mechanism configured to be in a non-contact engagement with the gyroscopic sensor when the gyroscopic sensor is in the first position or the second position.

A second embodiment may include the first embodiment, wherein the gyroscopic sensor comprises a plurality of gyroscopic sensors; and each of the plurality of gyroscopic sensors is configured to rotate between a corresponding first rotational position and a corresponding second rotational position about a corresponding indexing axis in the downhole tool body.

A third embodiment may include any one of the first through second embodiments, wherein the first rotational position and the second rotational position are circumferentially spaced by about 180 degrees.

A fourth embodiment may include any one of the first through third embodiments, wherein the non-contact detent is a non-contact magnetic detent.

A fifth embodiment may include the fourth embodiment, wherein the non-contact magnetic detent comprises first and second magnet pairs, each magnetic pair comprising a first magnet coupled to the gyroscopic sensor and a second magnet coupled to the downhole tool body.

A sixth embodiment may include any one of the first through fifth embodiments, further comprising a first intermittent gear rotationally coupled to the gyroscopic sensor, wherein the drive mechanism comprises a second intermittent gear engaged with and configured to rotate the first intermittent gear.

A seventh embodiment may include the sixth embodiment, wherein the first intermittent gear comprises first and second circumferentially spaced alignment features that are sized and shaped for non-contact engagement with a non-toothed section of the second intermittent gear when the gyroscopic sensor is in the corresponding first and second rotational positions.

An eighth embodiment may include any one of the sixth through seventh embodiments, wherein the drive mechanism further comprises an electric motor configured to rotate the second intermittent gear to thereby rotate the gyroscopic sensor between the first and second rotational positions.

A ninth embodiment may include any one of the sixth through eighth embodiments, wherein the gyroscopic sensor comprises a plurality of gyroscopic sensors, each of the plurality of gyroscopic sensors being configured to rotate between a corresponding first rotational position and a corresponding second rotational position about a corresponding indexing axis in the downhole tool body; each of the plurality of gyroscopic sensors is rotationally coupled with a corresponding first intermittent gear; each of the first intermittent gears is engaged with a corresponding second intermittent gear that is rotationally coupled with the drive mechanism, each of the first intermittent gears and the corresponding second intermittent gear are configured to be in non-contact engagement when the corresponding gyroscopic sensor is in the first rotational position and the second rotational position; and the drive mechanism further comprises an electric motor configured to rotate each of the plurality of gyroscopic sensors between the corresponding first rotational position and the corresponding second rotational position via rotating the corresponding second intermittent gears.

A tenth embodiment may include the ninth embodiment, wherein the non-contact detent comprises a plurality of non-contact magnetic detents configured to secure each of the corresponding plurality of the gyroscopic sensors in either the corresponding first rotational position or the corresponding second rotational position.

In an eleventh embodiment, a method for removing sensor bias from a downhole gyroscopic measurement includes deploying a gyroscopic surveying tool in a subterranean wellbore, the gyroscopic surveying tool including a gyroscopic sensor deployed in and configured to rotate between a first rotational position and a second rotational position about an indexing axis in a downhole tool body, a non-contact detent configured to secure the gyroscopic sensor in either the first rotational position or the second rotational position, and a drive mechanism configured to rotate the gyroscopic sensor between the first rotational position and the second rotational position, the drive mechanism configured to be in a non-contact engagement with the gyroscopic sensor when the gyroscopic sensor is in the first rotational position or the second rotational position; rotating the gyroscopic sensor to the first rotational position; using the gyroscopic sensor to make a first gyroscopic measurement; rotating the gyroscopic sensor to the second rotational position; using the gyroscopic sensor to make a second gyroscopic measurement; and combining the first gyroscopic measurement and the second gyroscopic measurement to remove the sensor bias.

A twelfth embodiment may include the eleventh embodiment, wherein the non-contact detent is a non-contact magnetic detent comprising first and second magnet pairs, each magnetic pair comprising a first magnet coupled to the gyroscopic sensor and a second magnet coupled to the downhole tool body.

A thirteenth embodiment may include any one of the eleventh through twelfth embodiments, wherein the gyroscopic surveying tool further comprises a first intermittent gear rotationally coupled to the gyroscopic sensor and the drive mechanism further comprises a second intermittent gear engaged with and configured to rotate the first intermittent gear.

A fourteenth embodiment may include the thirteenth embodiment, wherein rotating the gyroscopic sensor to the second rotational position further comprises rotating the second intermittent gear out of the non-contact engagement with the first intermittent gear such that at least one tooth in the second intermittent gear engages at least one tooth in the first intermittent gear; further rotating the second intermittent gear to rotate the gyroscopic sensor from the first rotational position to the second rotational position; and still further rotating the second intermittent gear into the non-contact engagement with the first intermittent gear.

A fifteenth embodiment may include the fourteenth embodiment, wherein the non-contact detent is a non-contact magnetic detent; the non-contact magnetic detent secures the gyroscope in the first rotational position when rotating the second intermittent gear out of the non-contact engagement with the first intermittent gear; and the non-contact magnetic detent secures the gyroscope in the second rotational position when still further rotating the second intermittent gear into the non-contact engagement with the first intermittent gear.

In a sixteenth embodiment the downhole tool includes a downhole tool body; a gyroscopic sensor deployed in and configured to rotate between a first rotational position and a second rotational position about an indexing axis in the downhole tool body; a non-contact magnetic detent configured to secure the gyroscopic sensor in either the first rotational position or the second rotational position; an electric motor configured to rotate the gyroscopic sensor between the first rotational position and the second rotational position; a first intermittent gear rotationally coupled to the gyroscopic sensor; a second intermittent gear rotationally coupled with the electric motor and engaged with the first intermittent gear; and wherein the first intermittent gear and the second intermittent gear are configured to be in non-contact engagement when the gyroscopic sensor is in the first rotational position and the second rotational position.

A seventeenth embodiment may include the sixteenth embodiment, wherein the first intermittent gear comprises first and second circumferentially spaced alignment features that are sized and shaped for non-contact engagement with a nontoothed section of the second intermittent gear when the gyroscopic sensor is in the corresponding first and second rotational positions.

An eighteenth embodiment may include any one of the sixteenth through seventeenth embodiments, wherein the non-contact magnetic detent comprises first and second magnet pairs, each magnetic pair comprising a first magnet coupled to the gyroscopic sensor and a second magnet coupled to the downhole tool body.

A nineteenth embodiment may include any one of the sixteenth through eighteenth embodiments, wherein the gyroscopic sensor comprises first, second, and third gyroscopic sensors that collectively make up a triaxially gyroscopic sensor arrangement, each of the first, second, and third gyroscopic sensors being configured to rotate between a corresponding first rotational position and a corresponding second rotational position about a corresponding indexing axis in the downhole tool body; and the electric motor is configured to rotate each of the first, second, and third gyroscopic sensors between the corresponding first rotational position and the corresponding second rotational position by rotating.

A twentieth embodiment may include the nineteenth embodiment, further comprising first, second, and third first intermittent gears coupled to the corresponding first, second, and third gyroscopic sensors; and first, second, and third second intermittent gears rotationally coupled with the electric motor and engaged with the corresponding first, second, and third first intermittent gears.

Although a downhole gyroscope employing a non-contact gyroscopic indexing mechanism and certain advantages thereof have been described in detail, it should be understood that various changes, substitutions and alterations may be made herein without departing from the spirit and scope of the disclosure.

The invention claimed is:

1. A downhole tool comprising:

a downhole tool body;

a gyroscopic sensor deployed in the downhole tool body and configured to rotate between a first rotational position and a second rotational position about an indexing axis in the downhole tool body;

a non-contact magnetic detent deployed in the downhole tool body and configured to secure the gyroscopic sensor in either the first rotational position or the second rotational position; and a drive mechanism deployed in the downhole tool body and configured to rotate the gyroscopic sensor between the first rotational position and the second rotational position, wherein the drive mechanism is configured to be in a non-contact engagement with the gyroscopic sensor when the gyroscopic sensor is in the first position or the second position;

wherein the drive mechanism includes a first intermittent gear and a second intermittent gear, wherein the first intermittent gear is rotationally coupled to the gyroscopic sensor, wherein the second intermittent gear is configured to rotate the first intermittent gear, wherein the first intermittent gear includes at least one alignment feature that is configured to engage with a corresponding non-toothed section of the second intermittent gear in either the first rotational position or the second rotational position of the gyroscopic sensor.

2. The downhole tool of claim 1, wherein:

the gyroscopic sensor comprises a plurality of gyroscopic sensors; and each of the plurality of gyroscopic sensors is configured to rotate between a corresponding first rotational position and a corresponding second rotational position about a corresponding indexing axis in the downhole tool body.

3. The downhole tool of claim 1, wherein the first rotational position and the second rotational position are circumferentially spaced by about 180 degrees.

4. The downhole tool of claim 1, wherein the non-contact magnetic detent comprises first and second magnet pairs, each magnetic pair comprising a first magnet coupled to the gyroscopic sensor and a second magnet coupled to the downhole tool body.

5. The downhole tool of claim 1, wherein the at least one alignment feature of the first intermittent gear is configured to form an air gap between the at least one alignment feature and the corresponding non-toothed section of the second intermittent gear.

6. The downhole tool of claim 1, wherein the at least one alignment feature comprises first and second circumferentially spaced alignment features that are sized and shaped for non-contact engagement with the non-toothed section of the second intermittent gear when the gyroscopic sensor is in the corresponding first and second rotational positions.

7. The downhole tool of claim 1, wherein the drive mechanism further comprises an electric motor configured to rotate the second intermittent gear to thereby rotate the gyroscopic sensor between the first and second rotational positions.

8. The downhole tool of claim 1, wherein:

the gyroscopic sensor comprises a plurality of gyroscopic sensors, each of the plurality of gyroscopic sensors being configured to rotate between a corresponding first rotational position and a corresponding second rotational position about a corresponding indexing axis in the downhole tool body;

each of the plurality of gyroscopic sensors is rotationally coupled with a corresponding first intermittent gear;

each of the first intermittent gears is engaged with a corresponding second intermittent gear that is rotationally coupled with the drive mechanism, each of the first intermittent gears and the corresponding second intermittent gear are configured to be in non-contact engagement when the corresponding gyroscopic sensor is in the first rotational position and the second rotational position; and the drive mechanism further comprises an electric motor configured to rotate each of the plurality of gyroscopic sensors between the corresponding first rotational position and the corresponding second rotational position via rotating the corresponding second intermittent gears.

9. The method of claim 8, wherein the non-contact detent comprises a plurality of non-contact magnetic detents configured to secure each of the corresponding plurality of the gyroscopic sensors in either the corresponding first rotational position or the corresponding second rotational position.

10. A method for removing sensor bias from a downhole gyroscopic measurement, the method comprising:

deploying the downhole tool of claim 1 in a subterranean wellbore;

operating the drive mechanism of the downhole tool to rotate the gyroscopic sensor to the first rotational position;

using the gyroscopic sensor to make a first gyroscopic measurement;

operating the drive mechanism of the downhole tool to rotate the gyroscopic sensor to the second rotational position;

using the gyroscopic sensor to make a second gyroscopic measurement; and combining the first gyroscopic measurement and the second gyroscopic measurement to remove the sensor bias.

11. The method of claim 10, wherein the non-contact magnetic detent of the downhole tool comprises first and second magnet pairs, each magnetic pair comprising a first magnet coupled to the gyroscopic sensor and a second magnet coupled to the downhole tool body.

12. The method of claim 10, wherein the at least one alignment feature of the first intermittent gear is configured to form an air gap between the at least one alignment feature and the corresponding non-toothed section of the second intermittent gear.

13. The method of claim 10, wherein operating the drive mechanism of the downhole tool to rotate the gyroscopic sensor to the second rotational position further comprises:

operating the drive mechanism of the downhole tool to rotate the second intermittent gear out of the non-contact engagement with the first intermittent gear such that at least one tooth in the second intermittent gear engages at least one tooth in the first intermittent gear;

operating the drive mechanism of the downhole tool to further rotate the second intermittent gear to rotate the gyroscopic sensor from the first rotational position to the second rotational position; and operating the drive mechanism of the downhole tool to still further rotate the second intermittent gear into the non-contact engagement with the first intermittent gear.

14. The method of claim 10, wherein:

the non-contact magnetic detent of the downhole tool secures the gyroscopic sensor in the first rotational position when rotating the second intermittent gear out of the non-contact engagement with the first intermittent gear; and the non-contact magnetic detent of the downhole tool secures the gyroscopic sensor in the second rotational position when still further rotating the second intermittent gear into the non-contact engagement with the first intermittent gear.

15. A downhole tool comprising:

a downhole tool body;

a gyroscopic sensor deployed in the downhole tool body and configured to rotate between a first rotational position and a second rotational position about an indexing axis in the downhole tool body;

a non-contact magnetic detent deployed in the downhole tool body and configured to secure the gyroscopic sensor in either the first rotational position or the second rotational position;

an electric motor deployed in the downhole tool body and configured to rotate the gyroscopic sensor between the first rotational position and the second rotational position;

a first intermittent gear deployed in the downhole tool body and rotationally coupled to the gyroscopic sensor; and a second intermittent gear deployed in the downhole tool body and rotationally coupled to the electric motor and engaged with the first intermittent gear;

wherein the first intermittent gear includes at least one alignment feature that is configured to engage with a corresponding non-toothed section of the second intermittent gear in either the first rotational position or the second rotational position of the gyroscopic sensor.

16. The downhole tool of claim 15, wherein the at least one alignment feature comprises first and second circumferentially spaced alignment features that are sized and shaped for non-contact engagement with the non-toothed section of the second intermittent gear when the gyroscopic sensor is in the corresponding first and second rotational positions.

17. The downhole tool of claim 15, wherein the non-contact magnetic detent comprises first and second magnet pairs, each magnetic pair comprising a first magnet coupled to the gyroscopic sensor and a second magnet coupled to the downhole tool body.

18. The downhole tool of claim 15, wherein:

the gyroscopic sensor comprises first, second, and third gyroscopic sensors that collectively make up a triaxially gyroscopic sensor arrangement, each of the first, second, and third gyroscopic sensors being configured to rotate between a corresponding first rotational position and a corresponding second rotational position about a corresponding indexing axis in the downhole tool body; and the electric motor is configured to rotate each of the first, second, and third gyroscopic sensors between the corresponding first rotational position and the corresponding second rotational position by rotating.

19. The method of claim 18, further comprising:

a set of three first intermittent gears coupled to the corresponding first, second, and third gyroscopic sensors; and a set of three second intermittent gears rotationally coupled to the electric motor and engaged with the corresponding set of three first intermittent gears.

* * * * *